US006145171A

United States Patent [19]

Hoshino

[11] Patent Number: 6,145,171

[45] Date of Patent: Nov. 14, 2000

[54] CLASP FOR ACCESSORIES

[76] Inventor: Masahiro Hoshino, Sunny Crest Rikugien 405, 14-12, Komagome 1-chome, Toshima-ku, Tokyo, 170, Japan

[21] Appl. No.: 09/107,295

[22] Filed: Jun. 30, 1998

Related U.S. Application Data

[60] Provisional application No. 60/051,574, Jul. 2, 1997.

[51] Int. Cl.[7] ..... A44B 11/26

[52] U.S. Cl. ..... 24/573.1; 24/658; 24/656

[58] Field of Search ..... 24/573.1, 656, 24/652, 658

[56] References Cited

U.S. PATENT DOCUMENTS

| | | |
|---|---|---|
| 3,538,558 | 11/1970 | Croft . |
| 4,374,449 | 2/1983 | Stephenson et al. . |
| 5,787,736 | 8/1998 | Ling . |

FOREIGN PATENT DOCUMENTS

| | | |
|---|---|---|
| 7-30703 | 6/1995 | Japan . |
| 9-182609 | 7/1997 | Japan . |

*Primary Examiner*—James R. Brittain
*Attorney, Agent, or Firm*—Liniak, Berenato, Longacre & White

[57] ABSTRACT

A clasp device for accessories includes: a locking element provided with an locking hole or locking groove; and a clasp for the engagement with the locking element. The clasp comprises: a receiving member into which the locking element is inserted; a stopper member comprising a U-shaped plate and a push button and having an open space for receiving the receiving member; a coil spring for urging the inner lower end of the U-shaped plate into the inner region of the receiving member; and a positioning casing and a cover lid forming a clasp body. The receiving member is provided with an engaging opening through which the inner lower end of the U-shaped plate protrudes into the inner region of the receiving member. The push button of the stopper member is in the form of a hollow cylinder accommodating therein the coil spring. The stopper member is urged upwardly by the resilient action of the coil spring, thereby the inner lower end of the U-shaped plate is urged inwardly into the inner region of the receiving member. The clasp body is provided with an insertion hole communicating with the receiving member, allowing inserting and pulling out operations of the locking element.

5 Claims, 10 Drawing Sheets

(a)

(b)

B — B (a)

(b)

C — C

CLASP FOR ACCESSORIES

This application claims the benefit U.S. Provisional Application No. 60/051,574 filed Jul. 2, 1997.

BACKGROUND OF THE INVENTION

1. Field of the Invention

The present invention relates to a clasp device for accessories such as necklaces, bracelets and anklets.

2. Prior Art

Many different Clasp devices have been proposed for utilizing with a various accessories. One example of a conventional clasp device is disclosed in Japanese Laid-open Utility Model Publication No. 7-30730. As shown in FIGS. 14(*a*) to (*c*), the clasp device includes a clasp 22 and a locking pin 23 as a locking element. The locking pin 23 has a rounded forward end for facilitating insertion thereof and a locking groove 23*a* provided peripherally of the locking pin 23 at a position proximate to the rounded forward end. The clasp 22 comprises: a positioning casing 24 for positioning a various assembly parts; a receiving member 25 in the form of a hollow tube for receiving therein the locking pin 23; a stopper member 26 having a center opening for receiving the receiving member 25 and movable into the inner region of the receiving member 25; a coil spring 27*a* accommodated in a spring case 27 for urging the stopper member 26 outwardly from the clasp 22; and a cover lid 28 into which the positioning casing 24 is fitted. As best seen in FIGS. 14(*a*) and (*c*), the stopper member 26 consists of a generally U-shaped plate 26*a* and a push button 26*b*, defining therein a center opening for receiving the receiving member 25. The stopper member 26 is supported at its bottom by the coil spring 27*a* within the spring case 27, thereby urged upward by resilient action of the coil spring 27*a*. The receiving member 25 is halfway inserted into the stopper member 26 through the center opening of the stopper member 26. To this end, at the inserted portion of the receiving member 25, thickness of the tubular cross section is partly reduced to have the outer width corresponding to the inner width of the U-shaped plate 26*a*. The receiving member 25 is provided with an engaging opening, which is engaged with the inner lower end 26*c* of the stopper member 26 upon insertion of the receiving member through the center opening of the stopper member 26. As shown in FIG. 14(*c*), since the stopper member 26 is urged upward by the coil spring 27*a*, the inner lower end 26*c* of the stopper member 26 extends inwardly through the engaging opening into the inner region of the receiving member 25.

When the locking pin 23 is inserted into the clasp 22 though the insertion opening communicating with the receiving member 25, the stopper member 26 is depressed against the resilient action of the coil spring 27*a* with its inner lower end 26*c* depressed by the peripheral surface of the locking pin 23, and in a position where the rounded forward end of the locking pin 23 has passed the inner lower end 26*c*, the stopper member 26 is again urged upward and its inner lower end 26*c* engages with the locking groove 23*a* of the locking pin 23.

Disengagement of the clasp device is accomplished by pulling out the locking pin 23 while depressing the push button 26*b* against the resilient action of the coil spring 27*a*.

In such clasp device, when assembled, the clasp 22, the receiving member 25, the stopper member 26 and the spring case 27 accommodating the coil spring 27*a* are assembled with the cover lid 28. However, since the coil spring 27*a* is to be accommodated in the spring case 27, brazing of the receiving member 25 and the spring case 27 would result in deterioration of the coil spring 27*a* due to heat generated during the brazing operation. Therefore, the stopper member 26 and the spring case 27 should be assembled with the cover lid 28 by finger operation or by the use of a tweezers. For this reason, as shown in FIG. 14(*d*), the upper surface of the spring case 27 is formed to have an arcuate surface corresponding to the peripheral surface of the receiving member 25 and a pair of protrusions so as to facilitate positioning of the receiving member 25. However, since the size of the protrusions are restricted in a small clasp, engagement of the receiving member 25 and the spring case 27 is very much likely to come off. This makes the whole assembly difficult and time-consuming.

Also, since the clasp 22 includes the spring case 27 at the lower end of the cover lid 28, size of the clasp becomes larger.

Further, since the receiving member 25 is provided with an engaging groove for the engagement with the protrusions of the spring case 27, and the positioning casing 24 is provided with a cut-out for positioning the spring case 27, the number of working processes is increasing. This also leads to increasing number of assembly processes as well as increment in cost.

With the foregoing difficulties of the prior art clasp device in view, the present invention seeks to provide a clasp device comprising reduced number of assembly parts, which contributes to reduced cost and facilitating the assembly thereof The present invention also seeks to provide a small-sized clasp device for accessories.

SUMMARY OF THE INVENTION

According to the present invention, there is provided a clasp device for accessories in combination with a locking element provided with an locking hole or locking groove; and a clasp engaging with the locking element, the clasp comprising:

a receiving member into which the locking element is inserted, the receiving member being provided with an engaging opening;

a stopper member engaging with said receiving member, the stopper member including an engaging portion for engagement with the locking hole or locking groove of said locking element through the engaging opening of the receiving member, and a push button extending outwardly from the clasp;

a coil spring urging the engaging portion of said stopper member into engagement with the locking hole or locking groove of said locking element; and a clasp body accommodating therein said receiving member, said stopper member and said coil spring;

characterized in that said push button is in the form of a hollow cylinder and that said coil spring is accommodated in the push button.

Other objects and features of the present invention will become apparent by reference to the following detailed description taken in conjunction with the accompanying drawings.

DESCRIPTION OF THE PREFERRED EMBODIMENT

Figure 1:
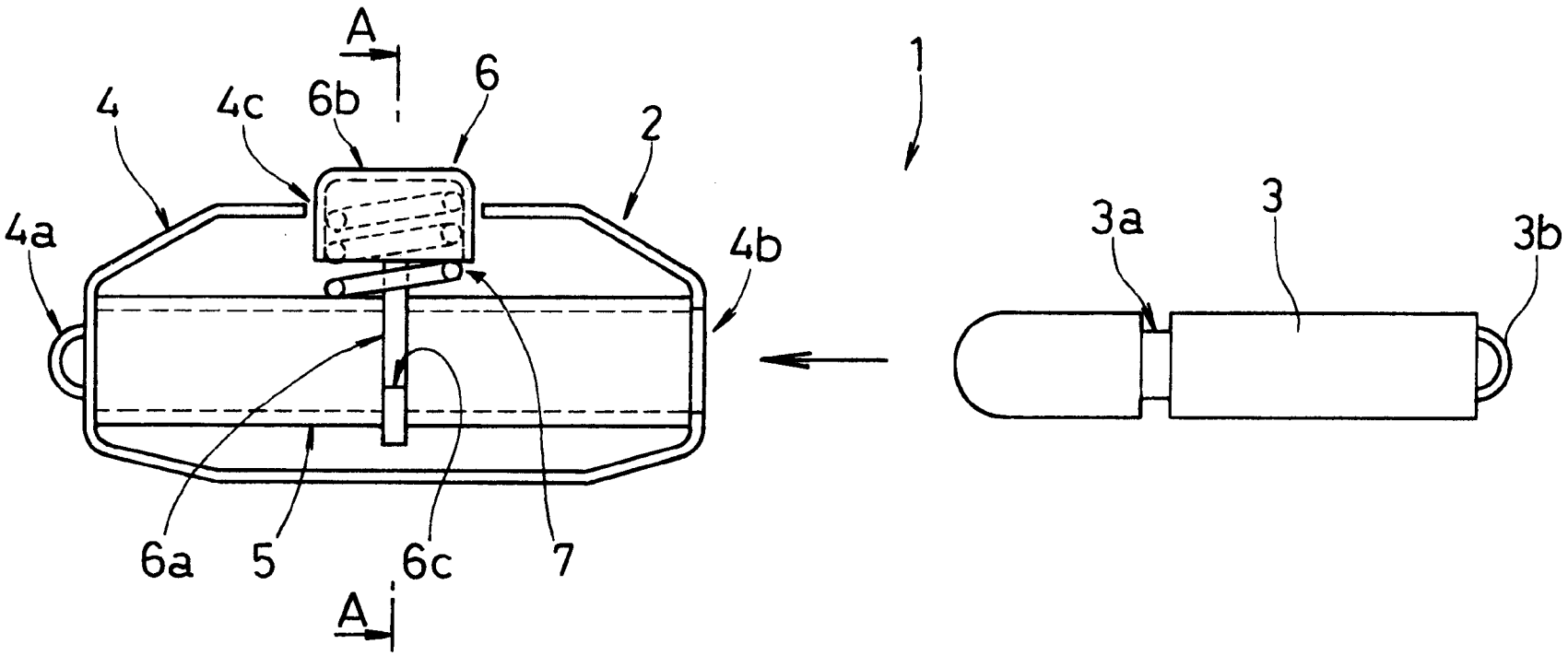
FIG. 1 is a partly sectional side view of a clasp device according to the present invention, in which the clasp device is made in combination with a locking pin and a clasp.
Figure 2:
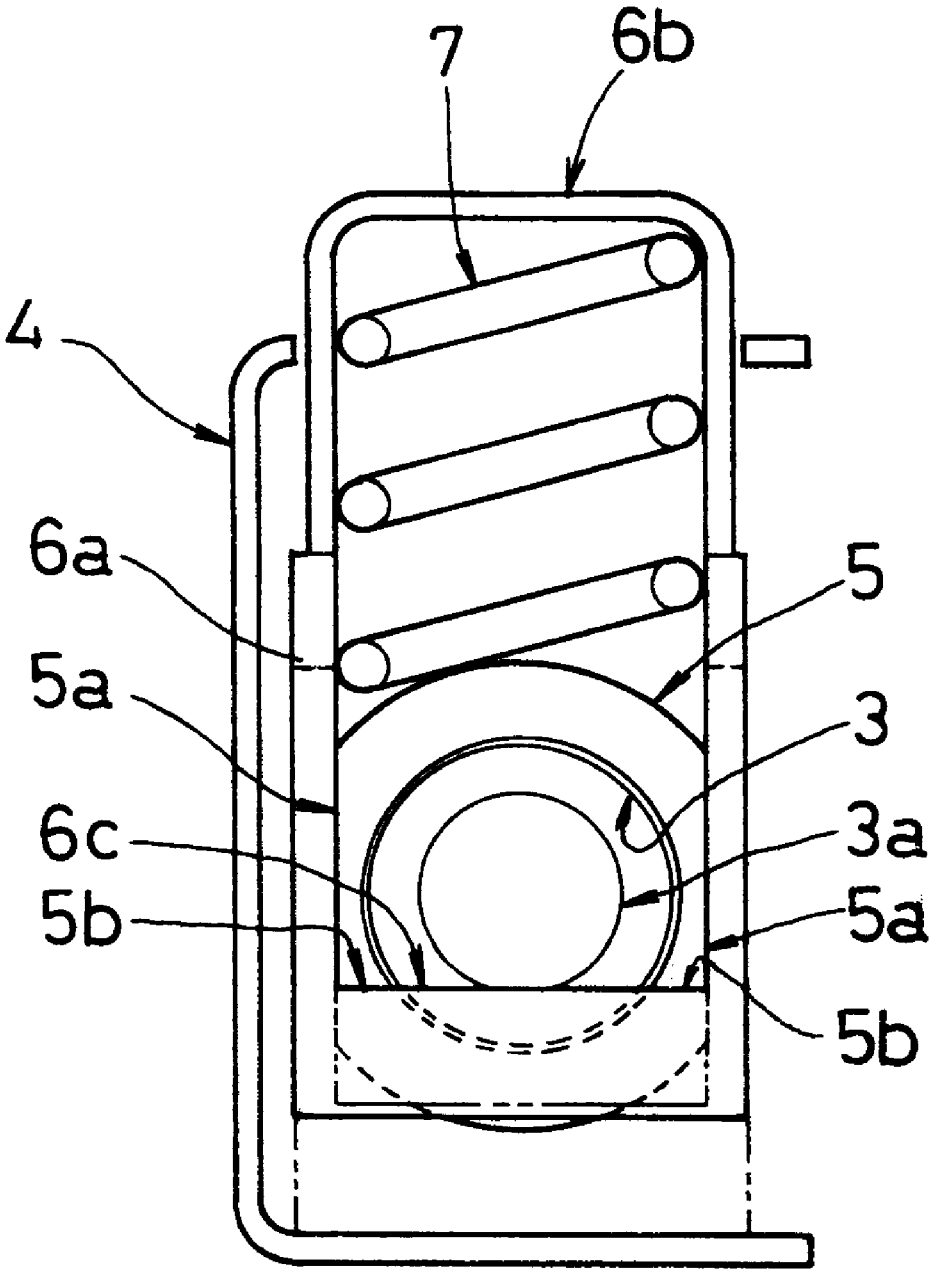
FIG. 2 is a sectional view taken along the line A—A of FIG. 1.
Figure 3:
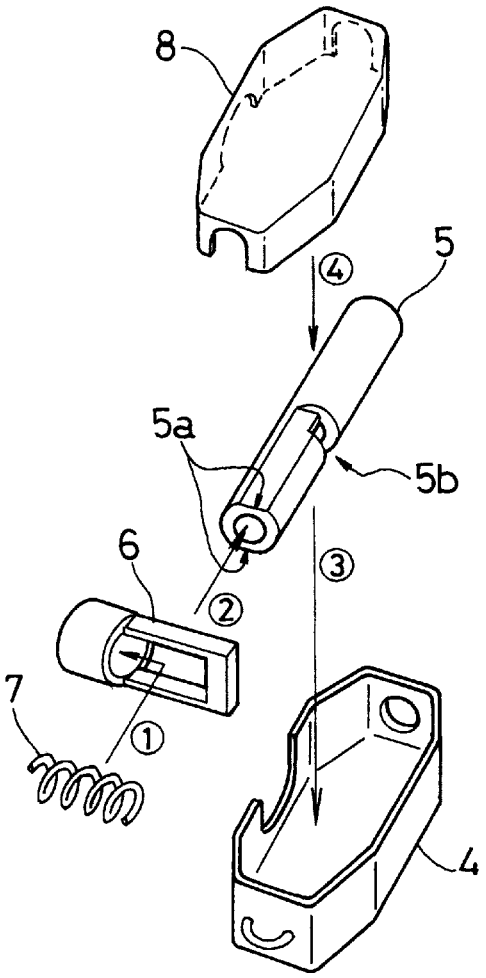
FIG. 3 is an exploded perspective view of the clasp.

Referring now to FIGS. 1 to 3, a clasp device 1 according to the present invention is shown, in which the clasp device 1 is made in combination with a clasp 2 and a locking pin 3, respectively connected at one end to the corresponding end of a strand of jewels.

As shown in FIG. 1, the locking pin 3 is in the form of a straight bar movable into and out from the clasp 2 and is provided with a rounded forward end for facilitating the insertion thereof, a locking groove 3*a* provided peripherally of the locking pin 3 at a position proximate to the rounded forward end, and a connecting ring 3*b* at its rear end for connecting one end of the strand of jewels.

As shown in FIGS. 1 and 3, the clasp 2 comprises a cover lid 4, a receiving member 5, a stopper member 6, a coil spring 7, and a positioning casing 8. A clasp body for accommodating a locking mechanism comprising the assembled parts, such as the receiving member 5, the stopper member 6 and the coil spring 7 is formed by the cover lid 4 and the positioning casing 8.

The cover lid 4 is provided at one end with a connecting ring 4*a* for connecting the other end of the strand, while at the opposite end facing to the connecting ring 4*a* there is provided an insertion hole 4*b* for insertion of the locking pin 3. The top surface of the cover lid 4 is further provided with a cut-out 4*c* for the purpose hereinafter described.

The receiving member 5 is in the form of a hollow tube for receiving therein the locking pin 23. As best seen in FIG. 3, the receiving member 5 has reduced thickness in its cross section, which substantially extends from one end to the intermediate of the receiving member 5. In other words, thickness of the tubular cross section is partly reduced at the opposing sides of the receiving member 5, thereby providing two flat surfaces 5*a* facing each other and halfway extending longitudinally along the length of the receiving member 5. The receiving member 5 is also provided with a slit-like engaging opening 5*b* at its bottom intermediate portion.

The stopper member 6 consists of a generally U-shaped plate 6*a* and a push button 6*b* in the form of a hollow cylinder, both of which are fixed by brazing. The stopper member 6 defines therein an open space surrounded by the U-shaped plate 6*a* and the push button 6*b* for receiving the receiving member 5. The inner width of the U-shaped plate 6*a* corresponds to the outer width of the reduced thickness of the receiving member 5, and hence the receiving member 5 is slidably inserted into the open space of the stopper member 6 with its flat surfaces 5*a* guided in contact with the inner sides of the U-shaped plate 6*a*. When the receiving member 5 is halfway inserted into the stopper member 6, the receiving member 5 is restricted at the ends of the flat surfaces 5*a*, and that is the position where the engaging opening 5*b* is provided. As shown in FIGS. 1 and 2, the inner lower end 6*c* of the stopper member 6 is movable into and out from the engaging opening 5*b* of the receiving member 5 and functions as an engaging portion to be described in detail later.

The coil spring 7 is accommodated within the push button 6*b*, and when the receiving member 5 is inserted into the stopper member 6, the coil spring 7 positions between the receiving member 5 and the stopper member 6, urging the lower end 6*c* of the stopper member 6 upwardly through the engaging opening 5*b* into the inner region of the receiving member 5.

The positioning casing 8 is for receiving the locking mechanism, which consists of the receiving member 5, the stopper member 6 and the coil spring 7. The positioning casing 8 is provided with cut-outs at its top and both side portions for receiving and positioning the push button 6*b* and the receiving member 5.

The positioning casing 8 has an outer profile slightly smaller than that of the cover lid 4, thereby when assembled, the positioning casing 8 is fitted within the cover lid 4.

In the clasp 2 thus assembled, the insertion hole 4*b* of the cover lid 4 is in communication with the corresponding side cut-out made in the positioning casing 8, while the cut-out 4*c* of the cover lid 4 is superimposed on the corresponding cut-out provided at the top of the positioning casing 8, thereby providing an opening through which the push button 6*b* protrudes. The insertion hole 4*b* also communicates with the receiving member 5, allowing the insertion of the locking pin 3 into the receiving member 5. With the provision of the opposing pair of cut-outs made in the positioning casing 8, displacement of the receiving member 5 during inserting and pulling out operations of the locking pin 3 can be overcome.

As shown in FIG. 2, the receiving member 5 and the stopper member 6 are arranged within the clasp body such that when the push button 6*b* is depressed, the bottom end of the U-shaped plate 6*a* abuts against the inner bottom end of the clasp body. In such position, the inner lower end 6*c* of the stopper member 6 engages with the receiving member 5 within the thickness of the receiving member 5, thereby preventing the stopper member 6 from coming off from the receiving member. The relative position of the stopper member 6 and the receiving member 5 when depressed is shown in phantom.

Within the clasp 2, the stopper member 6 is usually urged upward by the coil spring 7 and thus the inner lower end 6*c* extends into the inner these two parts are firmly and snappingly engaged.

Operation of the clasp device 1 will be described below. When in use, the locking pin 3 connected at one end of a necklace is inserted into the clasp 2 connected at the other end of the necklace through the insertion hole 4*b* of the clasp 2. Provision of the rounded forward end facilitates the insertion of the locking pin 3. The locking pin 3 is guided along the inner region of the receiving member 5 with its rounded forward end depressing the inner lower end 6*c* of the stopper member 6, and when the forward end of the locking pin 3 has passed the inner lower end 6*c* of the stopper member 6, the stopper member 6 is displaced upward by the resilient action of the coil spring 7. This brings the inner lower end 6*c* into engagement with the locking groove 3*a* of the locking pin 3, thereby locking the clasp 2 and the locking pin 3.

To take off the necklace, the locking pin 3 is pulled out while depressing the push button 26*b* against the resilient action of the coil spring 27*a*. By depressing the push button 26*b*, the inner lower end 6*c* of the U-shaped plate 6*a* is retracted from the inner region of the receiving member 5, enabling the pulling out operation of the locking pin 3.

Figure 4:
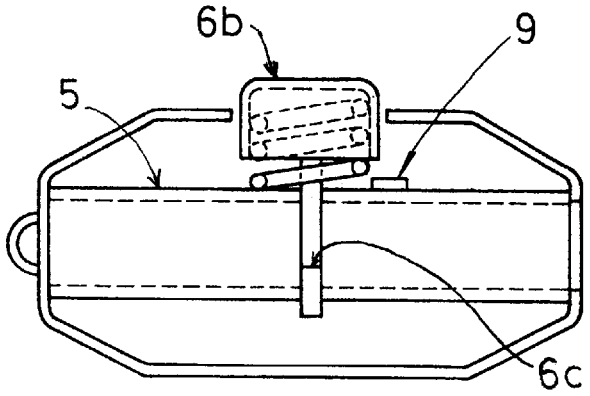
FIG. 4 shows a first modified form of the clasp device.

Referring now to FIG. 4, a first modified form of the clasp 2 comprises a protrusion 9. In the aforementioned clasp 2, the downward movement of the push button 6*b* is restricted by the engagement between the bottom end of the U-shaped plate 6*a* and the inner bottom end of the clasp body. However, in this modified form, the downward movement of the push button 6*b* is restricted by the protrusion 9. The protrusion 9 is provided so that when the push button 6*b* is depressed, the push button 6*b* engages with the protrusion 9 at a part of its bottom peripheral surface, thereby preventing the inner lower end 6*c* of the stopper member 6 from coming off from the region defined by the cylindrical cross section of the receiving member 5. When the push button 6*b* is depressed, the U-shaped plate 6*a* is displaced downwardly against the resilient action of the coil spring 7, retracting its inner lower end 6*c* off from the inner region of the receiving member 5.

With reference to FIG. 3, assembly of the clasp 2 will be described.

1. Insert the coil spring 7 into the hollow space within the push button 6*b* of the stopper member 6.

2. While compressing the coil spring 7, insert the receiving member 5 into the stopper member 6 through the open space defined by the U-shaped plate 6*a* and the push button 6*b*. Slide the receiving member 5 with the opposing flat surfaces 5*a* guided on the inner sides of the U-shaped plate 6*a*. When the receiving member 5 slides to the end of the flat surfaces 5*a*, the inner lower end 6*c* is urged by the resilient action of the coil spring 7 and is brought into engagement with the receiving member 5.

3. Place the thus assembled parts in the cover lid 4. According to the present invention, the coil spring 7 is accommodated between the receiving member 5 and the stopper member 6 forming a unit of assembled parts, which leads to facilitating the whole assembly of the clasp and improved working efficiency. Also since the inner longitudinal length of the cover lid 4 conforms with the longitudinal length of the receiving member 5, the receiving member 5 is fittingly positioned within the cover lid 4.

4. Fit the positioning casing 8 into the cover lid 4. The push button 6*b* and the receiving member 5 are received in the corresponding cut-outs of the positioning casing 8, therefore positioning of these parts is accomplished. Preferably, the cover lid 4 and the positioning casing 8 are provided with corresponding pairs of protrusions and recesses so that when assembled, engaging opening 5*b* of the receiving member 5. The protrusion may be formed by brazing after completing the assembly of the receiving member 5 and the stopper member 6. Alternatively, the cover lid 4 or the positioning casing 8 may be formed to have a protrusion engaging with the push button 6*b*.

Figure 5:
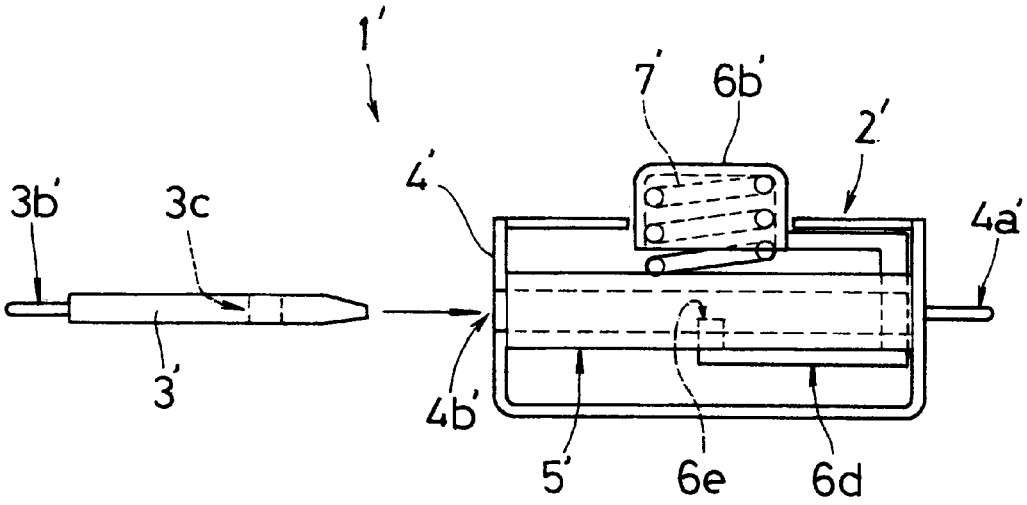
FIG. 5 shows a second modified form of the clasp device.
Figure 6:
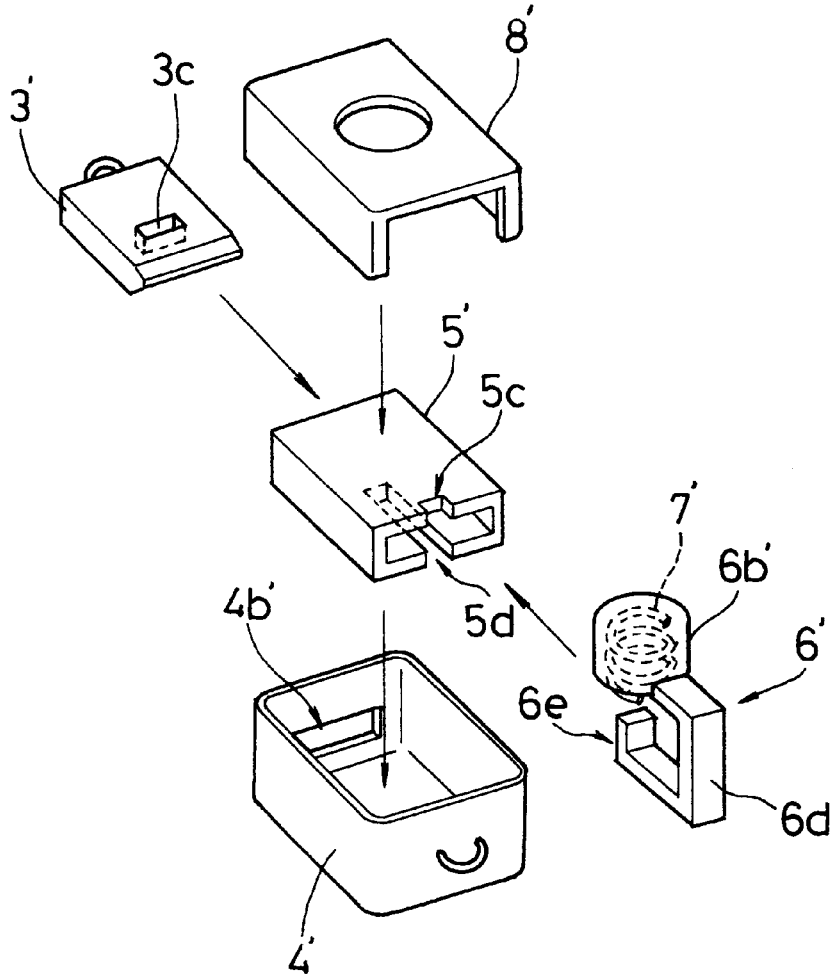
FIG. 6 shows an exploded perspective view of the clasp device shown in FIG. 5.

Referring to FIGS. 5 and 6, a second modified form of the clasp device 1 is shown, in which the clasp device 1' consists of a clasp 2' and a locking member 3' having a locking hole 3*c*. The clasp 2' is formed from the assembly parts, such as a cover lid 4' having an insertion hole 4*b*', a receiving member 5' for guiding the locking member 3', a stopper member 6' engaging with the receiving member 5' and movable into and out from the locking hole 3*c* of the locking member 3', a coil spring 7' urging the stopper member 6', and a positioning casing 8' fitted into the cover lid 4'.

The locking member 3' is a plate-like member. The locking hole 3*c* is provided around the center of the locking member 3' for engaging with the stopper member 6'. The forward end of the locking member 3' is formed to have tapering surfaces for facilitating the insertion and also enabling the depression of an engaging portion 6*e* to be described later. The rear end of the locking member 3' is provided with a connecting ring 3*b*' for connecting one end of a strand of jewels.

The cover lid 4' and the positioning casing 8' forms a clasp body for accommodating therein a locking mechanism comprising the receiving member 5', the stopper member 6' and the coil spring 7'. The cover lid 4' is in the form of an open box, same as the cover lid 4. The rectangular insertion hole 4*b*' is formed at one side wall of the cover lid 4'. A connecting ring 4*a*' is provided at the opposite side of the insertion hole 4*b*' for connecting the other end of the strand. The positioning casing 8 has a central opening for the purpose hereinafter described.

The receiving member 5' is a hollow rectangular box forming therein the space corresponding to the outer profile of the locking member 3'. The receiving member 5' is in communication with the insertion hole 4*b*' of the cover lid 4' so that the locking member 3' is inserted into the receiving member 5' through the insertion hole 4*b*'. The receiving member 5' is also provided with upper and lower guiding grooves 5*c*, 5*d* for guiding the stopper member 6'.

The stopper member 6' consists of a U-shaped plate 6*d* and a push button 6*b*'. The push button 6*b*' is formed as a hollow cylinder for accommodating the coil spring 7'. As shown in FIG. 6, the stopper member 6' is provided with an engaging portion 6*e* at one end of the U-shaped plate 6*d*. The stopper member 6' is engaged with the receiving member 5' with its U-shaped plate 6d guided along the upper and lower guiding grooves 5*c*, 5*d*. In such position, the engaging portion 6*e* of the stopper member 6' protrudes into the space where the locking member 3' is inserted.

The cover lid 4', the receiving member 5', the stopper member 6' and the positioning casing 8' are assembled into the clasp 2' by the following assembly process. The coil spring 7' is inserted into the push button 6*b*. The stopper member 6' is then engaged with the receiving member 5'. These assembled parts are placed into the cover lid 4'. Finally, the positioning casing 8' is fitted into the cover lid 4'. The cover lid 4' has round corners for attracting design. At the lower end of the cover lid 4', inner horizontal cross section of the cover lid 4' is contracting toward the bottom, thereby providing vertically and inwardly rounded bottom portion. As shown in FIG. 5, the receiving member 5' is positioned just above this rounded bottom portion. To this end, curvature of the opposing side walls is relatively greater. Meanwhile, curvature of the opposing front and rear walls, at which the connecting ring 4*a'* and the insertion hole 4*b'* are provided is relatively smaller such that when the push button 6*b'* is depressed, the U-shaped plate 6*d* is displaced downwardly toward the bottom end of the cover lid 4'.

The stopper member 6' is urged upward by the coil spring 7' so that the push button 6*b'* protrudes outwardly from the clasp 2 through the central opening of the positioning casing 8'. Since the stopper member 6' is abutting against the inner surface of the positioning casing 8', upward movement of the stopper member 6' is restricted. When the push button 6*b'* is depressed, the stopper member 6' is displaced downwardly with its U-shaped plate 6*d* supported by the inner surface of the cover lid 4' and the upper and lower guiding grooves 5*c*, 5*d* of the receiving member 5'. The downward movement of the stopper member 6' is restricted by the abutting engagement between the bottom peripheral surface of the push button 6*b'* and the upper surface of the receiving member 5'.

The stopper member 6' has a height such that the uppermost portion of the engaging portion 6*e* does not come off from the lower guiding groove 5*d* when depressing the push button 6*b'*.

Figure 7:
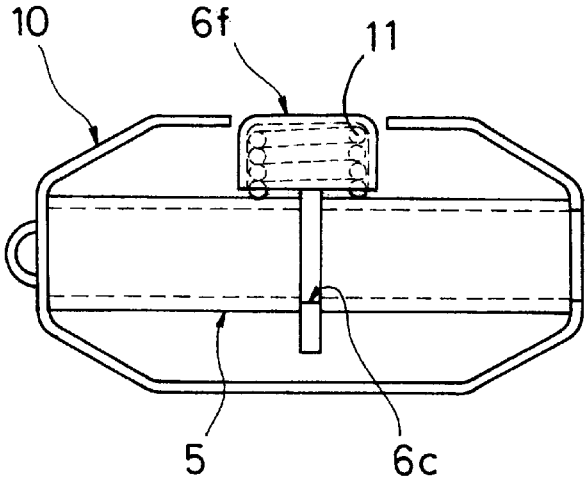
FIG. 7 shows a third modified form of the clasp device.

Referring to FIG. 7, a third modified form of the clasp is shown. In this figure, the push button 6f positions at the wholly depressed position. The coil spring 11 has a height, when compressed, to restrict the downward movement of the push button 6*f*. In other words, the contracted coil spring 11 defines the lower stroke end of the stopper member 6'. The engaging portion 6*c* is positioned within the thickness of the receiving member 5 when the push button 6*f* is wholly depressed.

Figure 8:
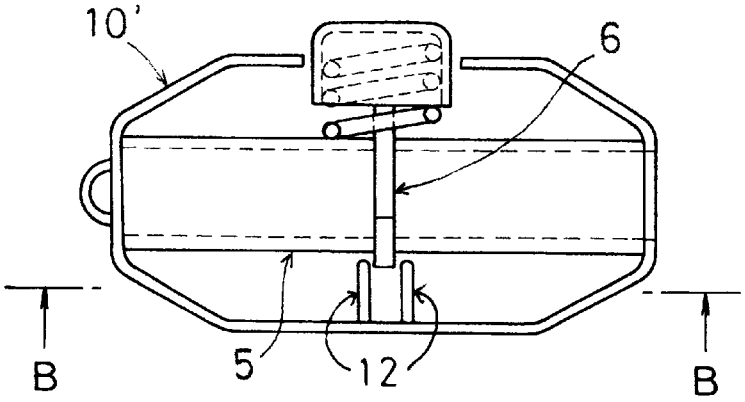
FIG. 8 shows a fourth modified form of the clasp device, in which (a) is a sectional view explaining the inner construction of the clasp, and (b) is a sectional view taken along the line B—B of FIG. 8(*a*).
Figure 8:
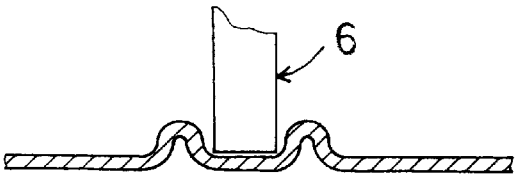

Referring now to FIGS. 8(*a*) and (*b*), a fourth modified form of the clasp is shown, in which the clasp 10' has a pair of guiding protrusions 12 defining therebetween a guiding groove for guiding the front and reverse surfaces of the stopper member 6. In this arrangement, the stopper member 6 returns to the engaging position even if the engaging portion comes off from the receiving member 5 upon depressing the push button. The cover lid itself may includes such guiding protrusions 12, or alternatively, the guiding protrusions may be formed on the inner surface of the cover lid by brazing.

Figure 9:
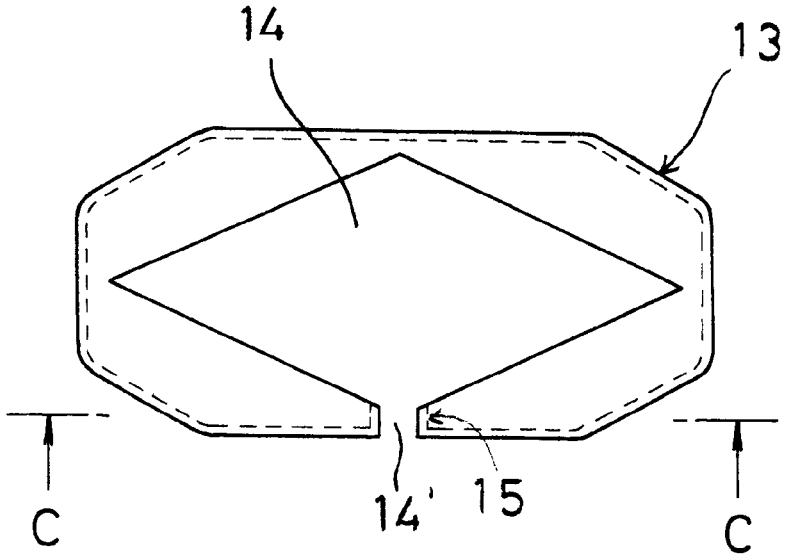
FIG. 9 shows a fifth modified form of the clasp device, in which (a) is an explanatory view of the clasp, and (b) is a sectional view taken along the line C—C of FIG. 9.
Figure 9:
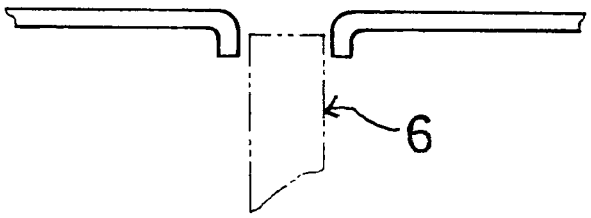

Referring to FIGS. 9(*a*) and (*b*), a fifth modified form of the clasp is shown. Here, the positioning casing 13 includes a central aperture 14 for positioning and attaching ornamental articles and a pair of inwardly bent portions 15. The bent portions 15 are formed at the terminated end 14' of the central aperture 14. When the positioning casing 13 is fitted into the cover lid, the pair of bent portions 15 defines a guide for the stopper member 6, thereby restricting sway of the stopper member 6. By this arrangement, the stopper member 6 returns to the engaging position even if the engaging portion comes off from the receiving member 5 upon depressing the push button.

Figure 10:
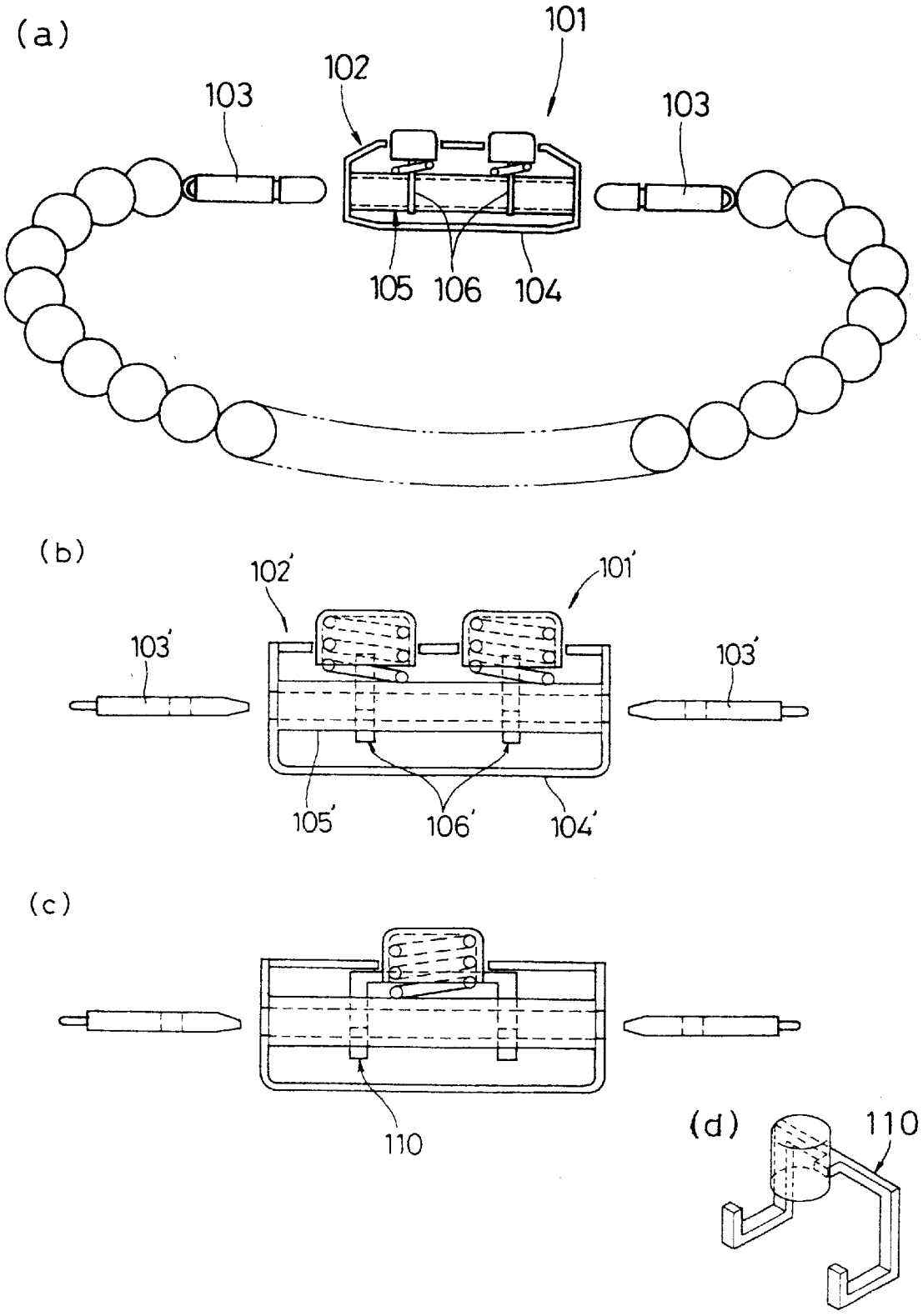
FIG. 10 shows further various modified forms of the clasp device, in which (a) shows a sixth modified form, (b) shows a seventh modified form, (c) shows an eighth modified form, and (d) is a perspective view of a stopper member used for the clasp shown in FIG. 10(*c*).

Referring to FIG. 10(*a*), a sixth modified form of the clasp device is shown, in which the clasp 101 includes two parallelly and symmetrically positioned locking mechanisms. The clasp 101 has a similar construction to the clasp 2 shown in FIG. 1, except that two stopper members 106 are used and that the longitudinal length of the receiving member 105 becomes greater so as to receive the two stopper members 106. The cover lid 104 is provided with two opposing insertion holes, each communicating with the receiving member 106. The clasp 101 is used with a pair of locking pins 103 connected at both ends of a strand of jewels.

Referring now to FIG. 10(*b*), a seventh modified form of the clasp device is shown, in which the clasp 101' has a similar construction to the clasp 2' shown in FIG. 5, except that two stopper members 106' are positioned parallelly and symmetrically within the clasp body 102' and that the receiving member 105' becomes greater in its longitudinal length. The cover lid 104' is provided with two opposing insertion holes for the insertion of the corresponding pair of locking members 103'.

Referring to FIGS. 10(*c*) and (*d*), an eighth modified form of the clasp device is shown, in which a two-legged stopper member 110 is used in place of the stopper members shown in FIGS. 10(*a*) and (*b*). In this clasp, the pulling out operation of the two locking pins or locking members is accomplished by depressing one push button.

Figure 11:
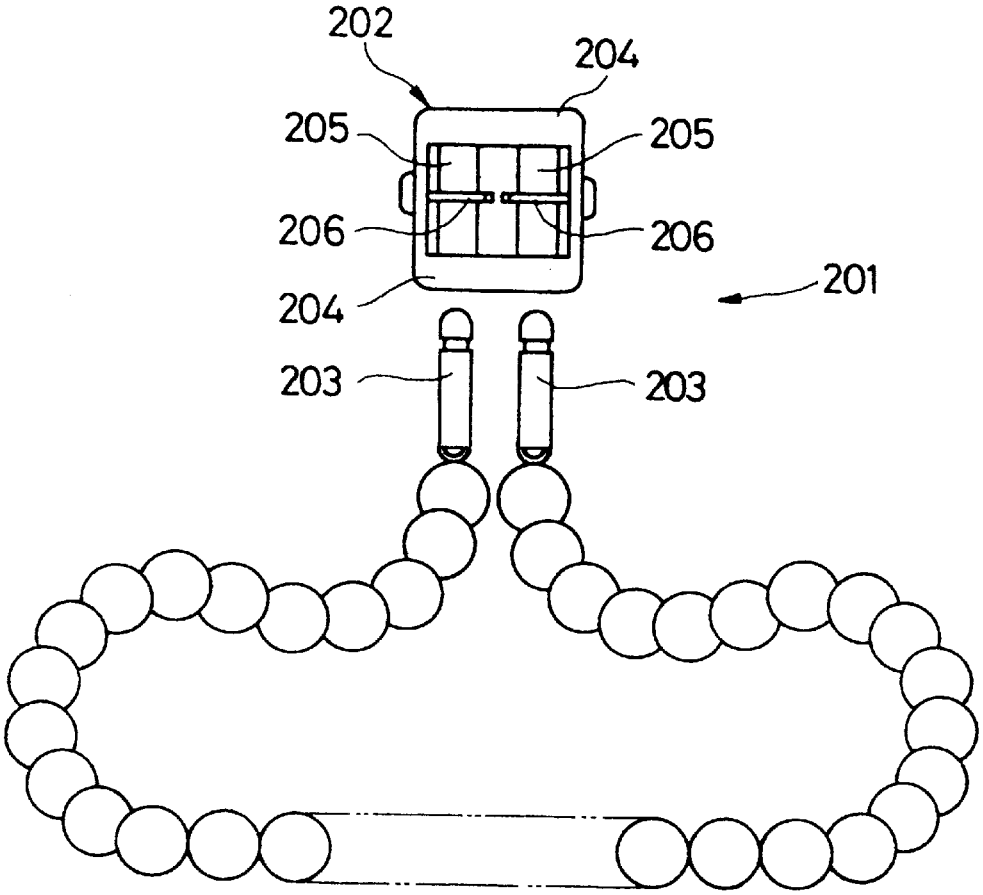
FIG. 11 shows a ninth modified form of the clasp device.

Referring now to FIG. 11, a ninth modifies form of the clasp device is shown, in which the clasp device 201 is made in combination with a pair of locking pins 203 and a clasp 202. The clasp 202 has a similar construction to the clasp 2 shown in FIG. 1, except that two sets of locking mechanisms, each of which comprises the receiving member 205 and the stopper member 206 are positioned parallelly and vertically within the cover lid 204. A pair of locking pins 203 are connected at both ends of a strand of jewels.

Figure 12:
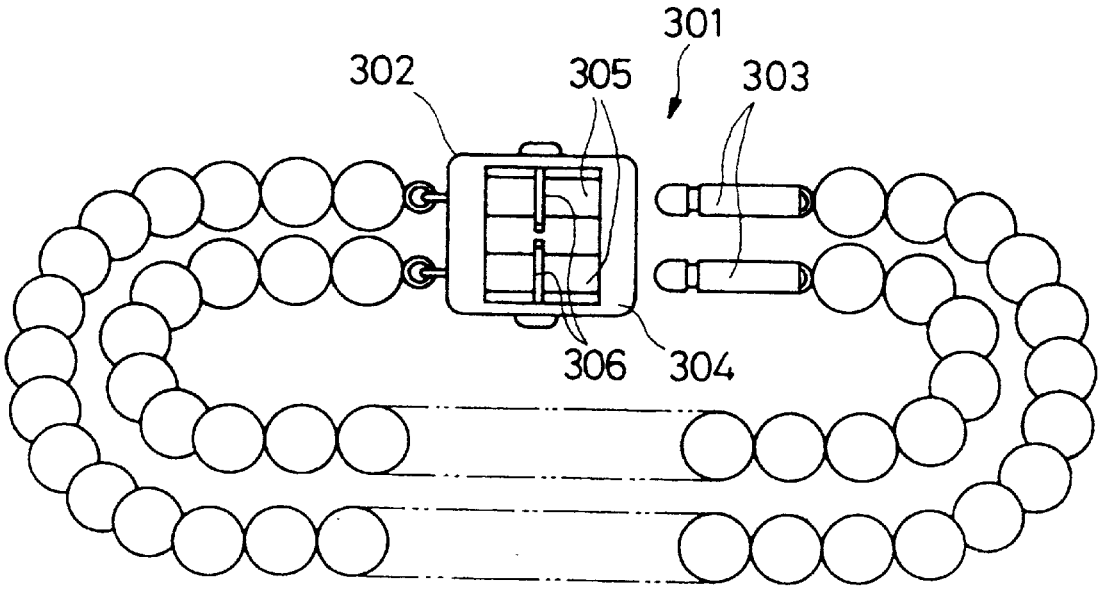
FIG. 12 shows a tenth modified form of the clasp device.

Referring to FIG. 12, a tenth modified form of the clasp device is shown, in which the clasp device 301 is used for a necklace with a double strand of jewels. The clasp device 301 is made in combination with a pair of locking pins 303 and a clasp 302. Each strand is connected at one end to the locking pin 303 and at the other end to the clasp 302. The clasp 302 has a similar construction to the clasp 2 shown in FIG. 1, except that two sets of locking mechanisms, each of which comprises the receiving member 305 and the stopper member 306 are positioned parallelly and horizontally within the cover lid 304.

Figure 13:
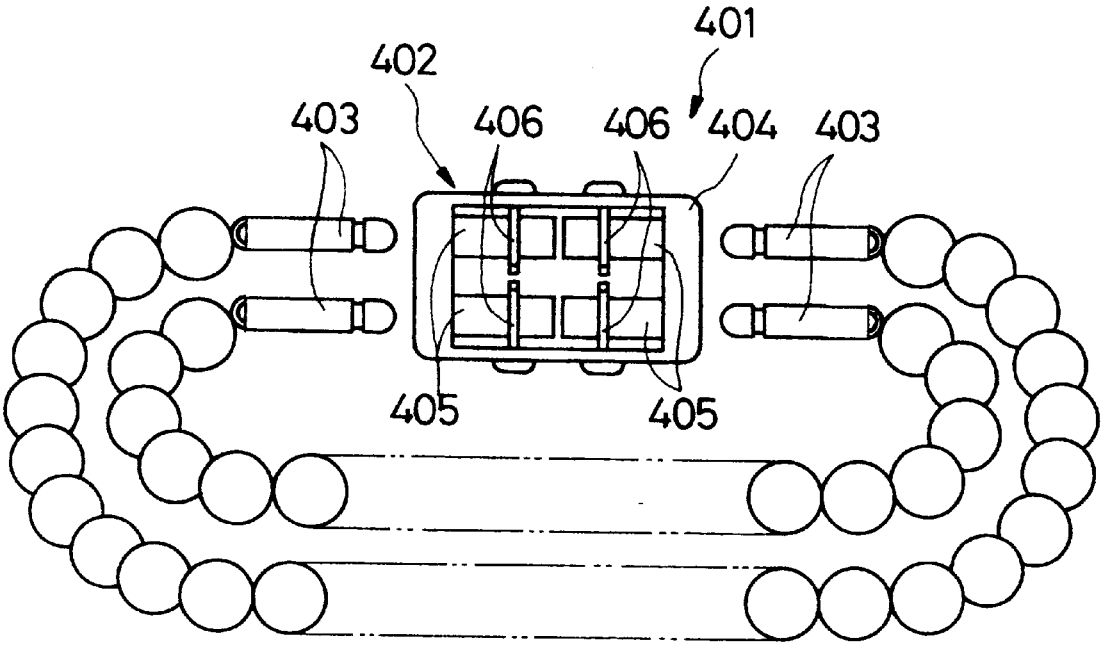
FIG. 13 shows an eleventh modified form of the clasp device.
Figure 14:
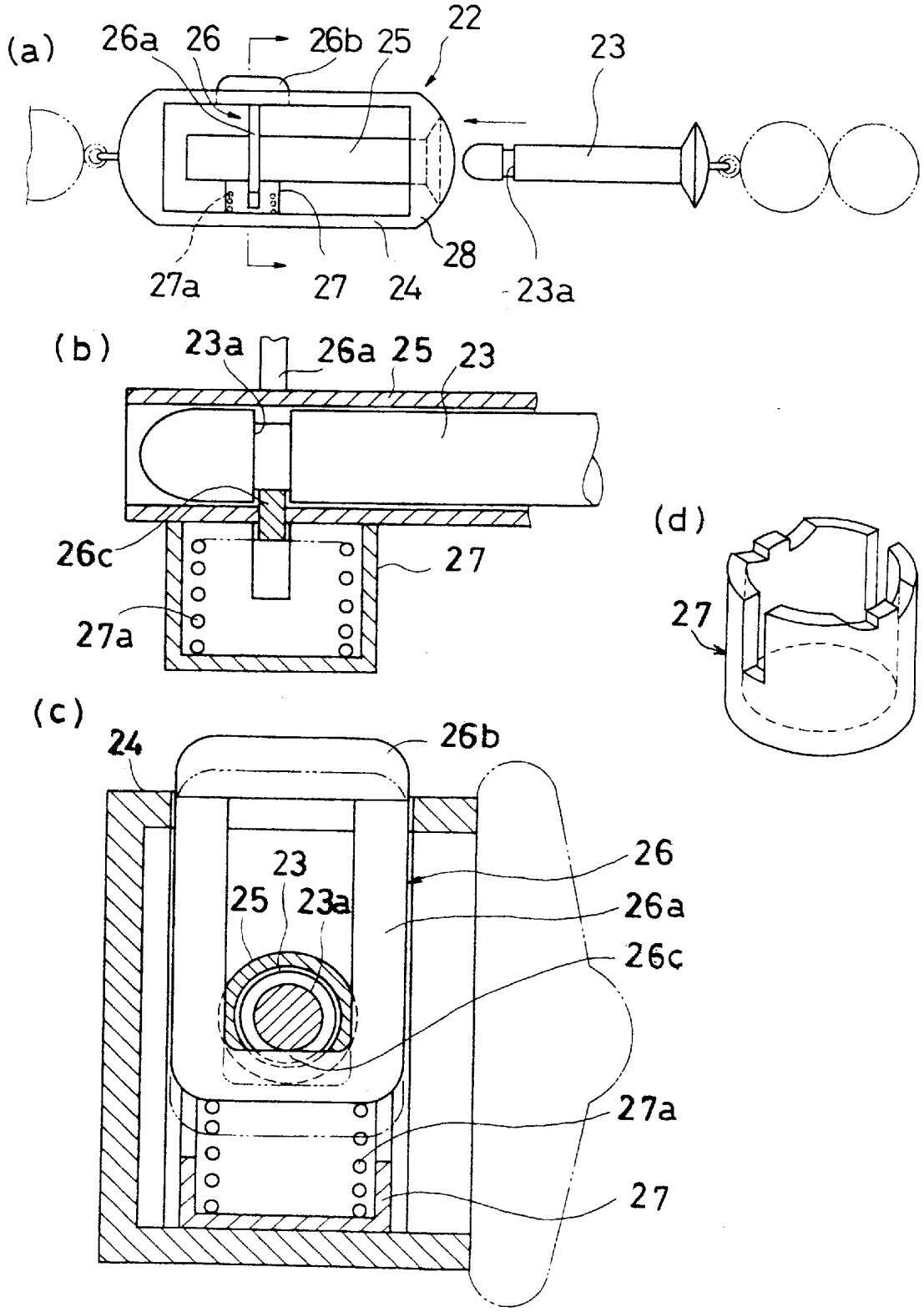
FIG. 14 PRIOR ART
FIG. 14 shows a conventional clasp device made in combination with a locking pin and a clasp, in which (a) is a partly sectional side view of the clasp device, (b) is an enlarged view explaining the inner construction of the clasp, (c) is a sectional view showing the engagement with a stopper member of the clasp and the locking pin, and (d) is a perspective view of a spring case accommodated in the clasp.

Referring now to FIG. 13, an eleventh modified form of the clasp device is shown, in which the clasp device 401 is used for a necklace with a double strand of jewels. The clasp device 401 is made in combination with two pairs of locking pins 403 and a clasp 402. The clasp 402 has a similar construction to the clasp 2 shown in FIG. 1, except that four sets of locking mechanisms, each of which comprises the receiving member 405 and the stopper member 406 are positioned within the cover lid 404. The length of the receiving member 405 may vary to receive two stopper members 406.

With the aforementioned clasp device of the present invention the following effects can be achieved, these are:

1. Assembly of the clasp is facilitated since respective assembly parts are made into a unit, followed by placing the unit into the cover lid.
2. The number of parts can be reduced since the coil spring is accommodated in the push button, which functions also as a spring case.
3. Size of the clasp becomes smaller since space for accommodating the spring casing is not required.
4. Various clasps can be made. Decorations on the clasp can vary by the use of small-sized clasps.
5. The number of working processes can be reduced. Since the clasp does not include the spring case, positioning parts for the spring case, such as the engaging groove of the receiving member and the cut-out of the positioning casing are dispensable.

6. Locking and unlocking operations can be smoothly performed. Since the downward movement of the stopper member is restricted, the stopper member does not come off from the receiving member.
7. With the use of two locking mechanisms one clasp may be compatible with other different strings, leading to variations in design.

What is claimed is:

1. A clasp device for accessories in combination with a locking element provided with a locking hole or locking groove; and a clasp engaging the locking element, the clasp comprising:

a locking mechanism provided as a pre-assembled modular unit, and a clasp body accommodating therein the locking mechanism, said locking mechanism comprising:

a receiving member into which the locking element is inserted, the receiving member being provided with an engaging opening;

a stopper member engaging said receiving member, the stopper member including an engaging portion for engagement with the locking hole or locking groove of said locking element through the engaging opening of the receiving member, and a hollow push button extending outwardly from the clasp;

a coil spring accommodated within said hollow push button and urging the engaging portion of said stopper member into engagement with the locking hole or locking groove of said locking element.

2. A clasp device according to claim 1, further including means for restricting the downward movement of the stopper member.

3. A clasp device according to claim 1, further including means for guiding the downward movement of the stopper member.

4. A clasp device according to claim 1, wherein said clasp includes two locking mechanisms for the engagement with two corresponding locking elements.

5. A clasp device according to claim 1, wherein said clasp includes four locking mechanisms for the engagement with two pairs of corresponding locking elements.

* * * * *